US007182324B2

(12) United States Patent
Baumhauer, Jr. et al.

(10) Patent No.: US 7,182,324 B2
(45) Date of Patent: Feb. 27, 2007

(54) MICROPHONE ISOLATION SYSTEM

(75) Inventors: John C. Baumhauer, Jr., Indianapolis, IN (US); Robert Spaller, Amesbury, MA (US); Thao D. Hovanky, Austin, TX (US); Larry Allen Marcus, Fishers, IN (US); Peter Chu, Lexington, MA (US); Denton L. Simpson, Round Rock, TX (US)

(73) Assignee: Polycom, Inc., Pleasanton, CA (US)

( * ) Notice: Subject to any disclaimer, the term of this patent is extended or adjusted under 35 U.S.C. 154(b) by 174 days.

(21) Appl. No.: 10/155,271

(22) Filed: May 23, 2002

(65) Prior Publication Data

US 2003/0197316 A1 Oct. 23, 2003

Related U.S. Application Data

(60) Provisional application No. 60/374,175, filed on Apr. 19, 2002.

(51) Int. Cl.
*H04R 1/02* (2006.01)

(52) U.S. Cl. ..... 267/136; 381/113; 381/357

(58) Field of Classification Search ..... 181/166, 181/171, 172; 381/197, 405, 151–368; 267/152, 267/153, 160, 162, 136; 248/550, 562; 188/379, 188/380

See application file for complete search history.

(56) References Cited

U.S. PATENT DOCUMENTS 2,260,727 A * 10/1941 Sears et al. ..... 381/151
3,653,625 A * 4/1972 Plice ..... 248/358 R
4,194,096 A * 3/1980 Ramsey ..... 381/366
4,281,222 A * 7/1981 Nakagawa et al. ..... 381/357
4,514,598 A * 4/1985 Plice ..... 381/368
4,607,383 A * 8/1986 Ingalls ..... 381/113
5,329,593 A * 7/1994 Lazzeroni et al. ..... 381/357
5,790,682 A * 8/1998 Hachiya et al. ..... 381/197
5,957,440 A * 9/1999 Jones et al. ..... 267/140.14
6,144,753 A * 11/2000 Ohyaba et al. ..... 381/405
6,443,273 B1 * 9/2002 Ledbetter et al. ..... 188/379
6,682,043 B1 * 1/2004 Hsieh ..... 248/638
6,695,106 B2 * 2/2004 Smith et al. ..... 188/378

OTHER PUBLICATIONS

"Professional Microphone Accessories, AT8410a/AT8415 Microphone Shock Mounts," Audio-Technica, Stow, OH, 1995.

* cited by examiner

*Primary Examiner*—Christopher P. Schwartz
(74) *Attorney, Agent, or Firm*—Wong, Cabello, Lutsch, Rutherford & Brucculeri, LLP

(57) ABSTRACT

A microphone isolation system. The system includes an isolation member, a support member, and at least two compliant members. The at least two compliant members mechanically support the isolation member and isolate the isolation member from vibrations. The at least two compliant members can also isolate the support member from any vibratory excitation source coupled to and/or supported by the isolation member.

25 Claims, 7 Drawing Sheets

MICROPHONE ISOLATION SYSTEM

CROSS-REFERENCES TO RELATED APPLICATIONS

This application claims priority from U.S. Provisional Patent Application No. 60/374,175, filed Apr. 19, 2002, and entitled "Microphone Isolation System," which is incorporated herein by reference for all purposes.

BACKGROUND OF THE INVENTION

1. Field of the Invention

The present invention relates generally to the field of audio fidelity, and more particularly to a vibration isolator such as a microphone isolation system.

2. Background of the Invention

The bandwidth capacity of telecommunications networks is expanding rapidly. This expansion has allowed commercially valuable services such as videoconferencing and voice-over-Internet conferencing to become viable and be technology growth areas. These services may be enhanced with wideband telephony capabilities for enhanced audio fidelity. Of course, terminals that support these services at user locations should be designed to produce and capture wideband voice signals from users. Traditional telephony, still prominent today and spanning from approximately 200 or 300 Hertz (Hz) through approximately 3500 Hz, has existed for over a century. A contemporary wideband telephony service and terminal spans, as an example, 50–7000 Hz or 80–14 kiloHertz (kHz).

There are various drawbacks to the prior art telephony approaches. For example, when one attempts to design a terminal's speech transducers (namely, the microphone and receiver in a handset or the microphone and loudspeaker in a hands-free "speakerphone" terminal) to exhibit wideband response, many acoustical and mechanical difficulties manifest themselves.

One problem that surfaces is that the microphone is exposed to the terminal's solid borne vibrations (e.g., vibrations resulting from a table, the terminal's fan or other moving part, or the terminal's loudspeaker voice coil motion) over a much broader frequency range than otherwise experienced. This problem is particularly troublesome at lower frequencies since mass or inertia of the terminal is not very effective at attenuating such solid borne vibrations before the terminal's microphone senses the vibrations. Virtually all microphones in use today are of an electret type. In spite of the electret microphones' light diaphragms, those diaphragms will still undergo a relative motion with respect to an electret's vibrating metal outer housing, which is normally attached to the terminal in a substantially rigid manner. This relative motion causes a mechanical noise signal to be produced, thus corrupting the terminal's transmission signal.

It is noteworthy that in traditional telecommunications products, electret microphones are typically housed in a rubber "boot" assembly prior to assembly into a terminal. This type of housing is used for acoustical sealing and provides no substantial vibration isolation.

One prior art attempt at isolating vibrations is shown in J. Audio Eng're Soc., February 1971, "Microphone Accessory Shock Mount for Stand or Boom Use," by G. W. Plice, and depicts a "new isolation mount." The reference shows a rubber shaped structure looking like a "donut" holding a central microphone load. A continuous annular plate supports the rubber "donut." The "donut" is curved and thus flexible in a direction normal to a bisecting horizontal plane of the load.

Referring to FIG. 1, another prior art attempt is found within the Panasonic PV-MK40 Camcorder. This camcorder exhibits a "second-order microphone structure" wherein an electret microphone is supported by a central annular rubber platform 100 with circumferentially staggered radial beam supports 102. Some of the beam supports 102 are affixed to a ring 104. The ring 104 is affixed to a wall 106 by other beam supports 108.

In another prior art attempt, shown and described in U.S. Pat. No. 5,739,481 to Baumhauer, Jr. et al., a loudspeaker mounting arrangement uses a compliant member to support and isolate a central loudspeaker load.

Although these prior art attempts may provide some level of isolation from vibrations, the vibration isolation can be improved. Therefore, there is a need for a system and method for providing improved vibration isolation.

SUMMARY OF THE INVENTION

The present invention provides in various embodiments a microphone isolation system for isolating vibrations due to a vibratory source external to the isolator system, or one internal to the isolator system. According to one embodiment of the present invention, a vibration isolator comprises an isolation member; a support member; and two or more compliant members. The compliant members mechanically support the isolation member and isolate the isolation member from vibrations emanating from the support member. At least some of the compliant members are coupled to the isolation member, are coupled to and supported by the support member, and are continuous from the isolation member to the support member. The compliant members exhibit a relatively high and advantageous ratio of mechanical compliance in all directions in a plane of the isolation member to the compliance in a direction normal to the plane of the isolation member.

In an alternative exemplary embodiment, the vibration isolator is configured to isolate the support member from vibrations emanating from a vibrating source coupled to (e.g., supported by, etc.) the isolation member.

A further understanding of the nature and advantages of the inventions herein may be realized by reference to the remaining portions of the specification and the attached drawings.

DESCRIPTION OF THE SPECIFIC EMBODIMENTS

Figure 1:
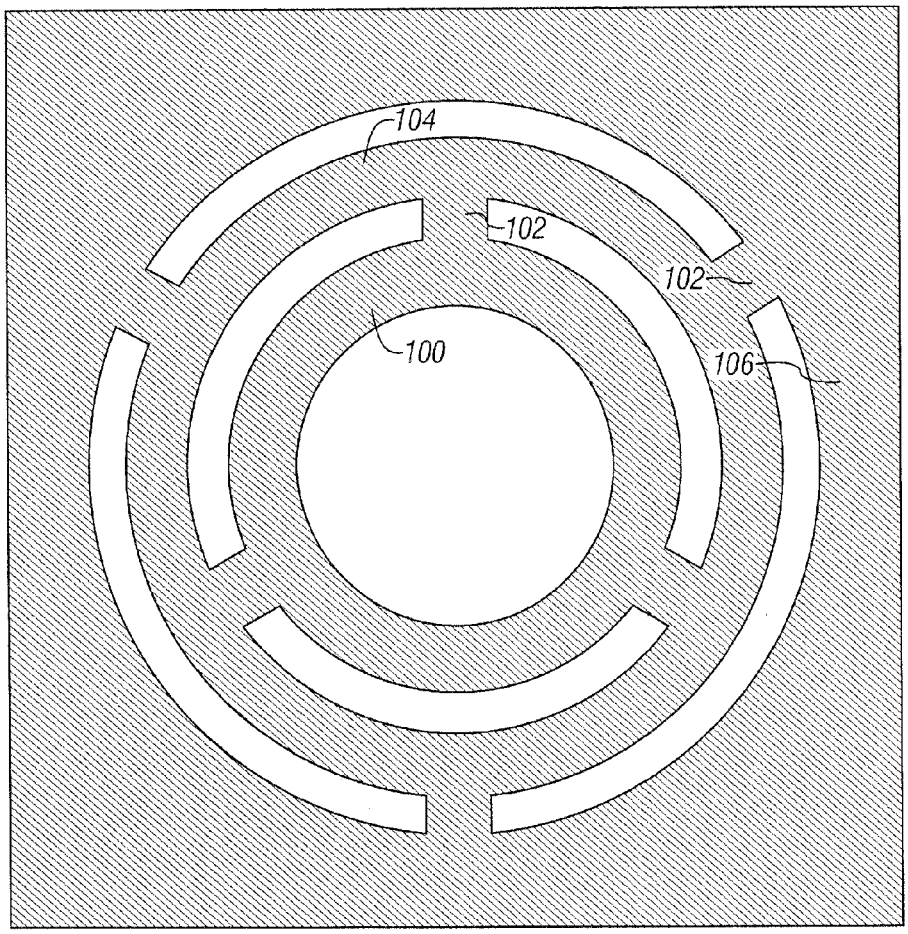
FIG. 1 (Prior Art)
FIG. 1 is a top view of a prior art attempt at a microphone isolation system.

As shown in the exemplary drawings wherein like reference numerals indicate like or corresponding elements among the figures, embodiments of a system according to the present invention will now be described in detail. The following description sets forth an example of a microphone isolation system.

Detailed descriptions of various embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, method, process, or manner.

As mentioned herein, various drawbacks to the prior art telephony approaches exist. For example, when one attempts to design a terminal's speech transducers to exhibit wideband response, there are numerous acoustical and mechanical difficulties that arise. One problem that arises is that the microphone is exposed to the terminal's solid borne vibrations (e.g., vibrations resulting from a table, the terminal's fan or other moving part, or the terminal's loudspeaker voice coil motion) over a much broader frequency range than otherwise. This problem is particularly troublesome at lower frequencies since the mass or inertia of the terminal is not very effective at attenuating such solid borne vibrations before the microphone senses the vibrations. It is especially helpful to be able to adequately attenuate vibrations in planes substantially orthogonal to the direction of gravity. The prior art does not accomplish this kind of attenuation satisfactorily.

Figure 2:
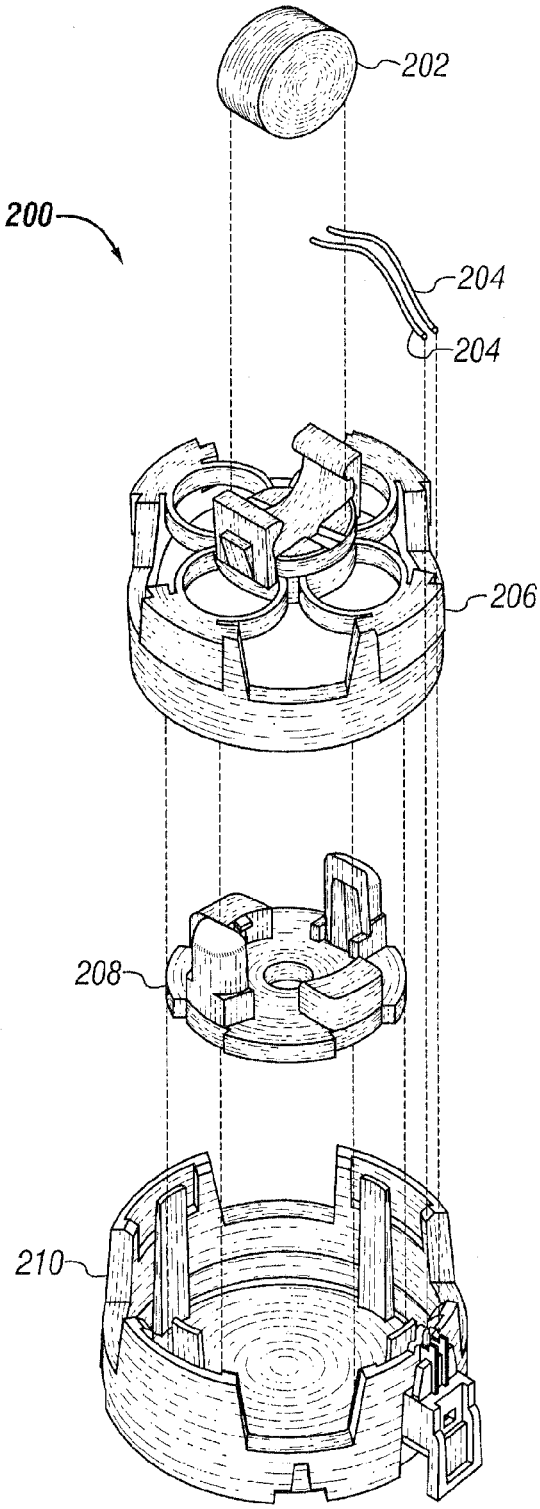
FIG. 2 is an exploded perspective view of an exemplary microphone isolation system according the present invention.

Referring to FIG. 2, an exploded view of an exemplary microphone isolation system 200, or a vibration isolator, according to the present invention is depicted. The microphone isolation system 200 supports an electret microphone 202 (or any other type of suitable microphone), and includes compliant wires 204, a top unit 206, a weight 208, and a base unit 210. As indicated in FIG. 2, the base unit 210 is configured to receive the weight 208. A more detailed discussion of the top unit 206, the weight 208, and the base unit 210 will be provided in connection with FIGS. 3, 4 and 5, respectively.

Figure 3:
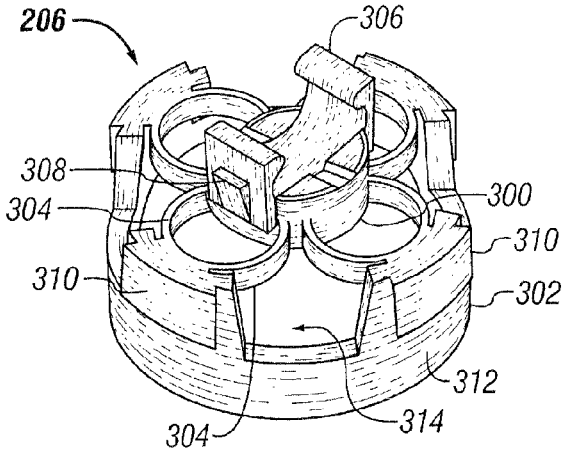
FIG. 3 is a perspective view of a top unit of the microphone isolation system of FIG. 2.

Referring now to FIG. 3, the top unit 206 is depicted. The top unit 206 comprises an isolation member 300, a support member 302, and two or more compliant members 304. Eight compliant members 304 are shown in FIG. 3 for illustrative purposes only. It is contemplated that more or fewer than eight compliant members 304 can be used. In one embodiment, the isolation member 300, the support member 302, and the compliant members 304 are formed from an elastomeric rubber. However, it is contemplated that other suitable materials can be used to produce these members.

The compliant members 304 mechanically support the isolation member 300 and separate the isolation member 300 from vibrations emanating from the support member 302. Further, the support member 302 is isolated from vibrations emanating from a vibrating source (e.g., the electret microphone 202 (FIG. 2), etc.) supported by the isolation member 300. At least some of the compliant members 304 (eight in the embodiment shown) are coupled to the isolation member 300, are coupled to and supported by the support member 302, and are continuous (unlike the prior art) from the isolation member 300 to the support member 302.

The isolation member 300 is configured to support the electret microphone 202 (not shown). A clamping arrangement 306 secures the electret microphone 202 to the isolation member 300. A wedge 308 facilitates securing of the isolation member 300 to the weight 208 (FIG. 2). In FIG. 3, only one wedge 308 is shown. However, in an alternative embodiment a second wedge 308 exists directly opposite to the first wedge 308 on the clamping arrangement 306.

Additionally, an extended area 310 juts out slightly from a sidewall 312 of the top unit 206. The extended area 310 facilitates securing of the isolation member 300 to the base unit 210 (FIG. 2), as discussed herein. In the present exemplary embodiment, there are four extended areas 310. Additionally, in the embodiment shown, there are four first crevices 314. The first crevices 314 line up with crevices in the base unit 210 (FIG. 2) to provide for a good fit.

One or more of the compliant members 304 of the top unit 206 are curved in shape, in one embodiment. In the present embodiment, all of the compliant members 304 are curved. The curvature exists in a plane parallel to the isolation member 300. As mentioned herein, prior art devices existed where curvature existed in a direction normal to a bisecting horizontal place of a microphone, as opposed to parallel. Moreover, the compliant members 304 are orthogonally symmetric (i.e., have a pattern that repeats itself every 90 degrees) in a plane parallel to the isolation member 300, and are radially oriented and emanate from the support member 302. This configuration ensures that external vibratory excitation in any direction in the plane of the isolation member 300 sees the same isolating mechanical compliance.

It is noteworthy that the shapes of the compliant members 304 substantially resemble arcs of circles in one embodiment. That is, the compliant members 304 have constant radii of curvature. In one embodiment, the curvature of the compliant members 304 spans an included angle of greater than 30 degrees. In another embodiment, the curvature of the compliant members 304 spans an included angle of greater than 90 degrees. However, it is envisioned that the curvatures can span any suitable number of degrees.

Further to the embodiment shown in FIG. 3, the compliant members 304 occur in pairs. In one embodiment, each pair of the compliant members 304 comprises compliant members 304 having opposite curvatures with respect to a radial coordinate. This configuration helps minimize any twisting motion of the isolation member 300 in its plane. The compliant members 304 are relatively narrow in width, but thicker in the direction of gravity, in one embodiment. The circular array of the complaint members 304 is designed to present the isolation member 300 and its mass load (including the electret microphone 202) with an unusually high radial compliance to effect high vibration isolation.

In further embodiments of the present invention, the support member 302 is circular in shape, having an inner diameter and an outer diameter. Preferably, the inner diameter is less than 30 millimeters (mm). However, it is contemplated that the inner diameter can be greater than or equal to 30 mm.

In prior art devices such as those of FIG. 1, the compliance in a direction normal to a plane of the beam supports 102, which is also the direction of gravity, is substantially greater than the radial compliance since normal motion involves bending of the beam supports 102 and 108, whereas radial motion attempts to compress the beam supports 102 and 108 (compression stores more mechanical potential energy). Thus, these prior art devices cannot protect against planar vibration excitation nearly as well as they can protect against normal excitation.

Moreover, high normal compliance can result in large initial (elastic) deflections under gravity and large viscoelastic "creep" deflections over time and temperature in service. The microphone isolation system 200 (FIG. 2) addresses these problems by maximizing the ratio of the radial-to-normal mechanical compliance. The narrow and curved compliant members 304 limit the energy stored in the compression mode upon radial excitation, and allow the compliant members 304 to "give" more in a lower energy bending mode. Moreover, in one exemplary embodiment, the compliant members 304 are several times as thick in the normal direction as they are wide which limits the compliant members' 304 total normal deflections under gravity, thus saving valuable space.

Figure 3A:
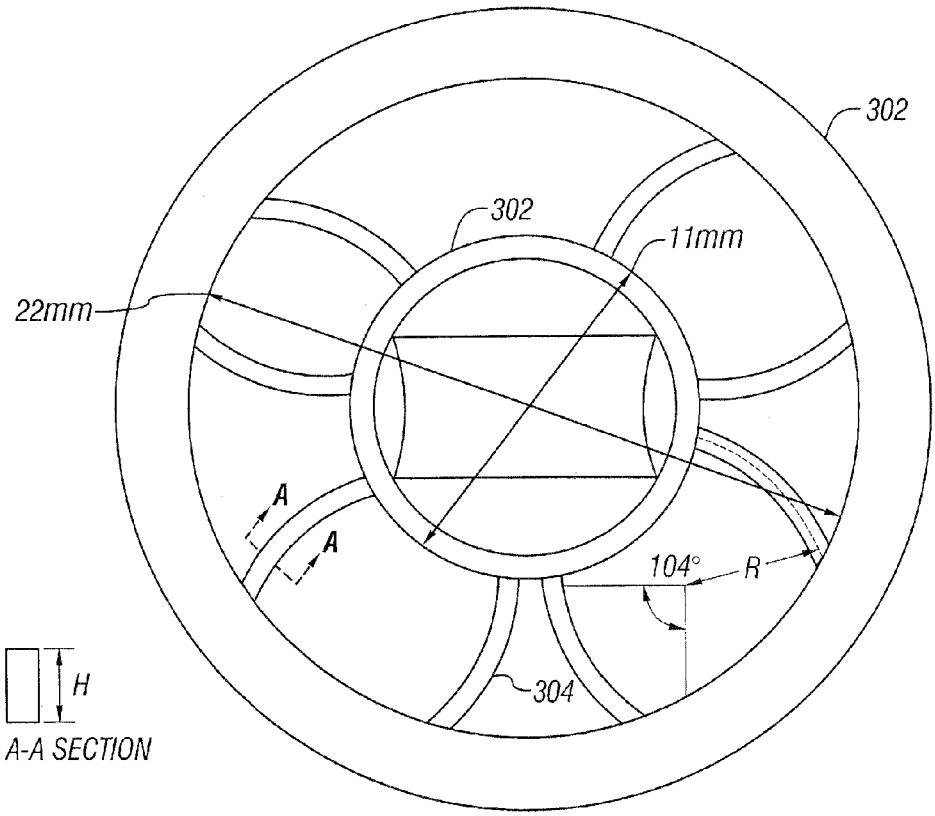
FIG. 3A is a schematic top view of a top unit of an exemplary microphone isolation system.

For example, suppose one desires to isolate a microphone from all frequencies above f Hz by at least D dB. In one embodiment, referring to FIG. 3A, eight compliant members 304 of radius R and width W (in the radial direction, perpendicular to the direction of gravity) are used, where R is 4.2 mm and W is between 0.53 and 0.46 mm (since the compliant members 304 may taper slightly to accommodate the molding process used). The height of complaint members 304 (in the direction of gravity), H, is 2.1 mm. The diameter of isolation member 300 is 11 mm, and the inner diameter of the support member 302 is 22 mm. Finally, the compliant members 304 subtend an included angle of about 104 degrees, in one embodiment.

In one embodiment, the compliant members 304 are molded integral with the isolation member 300 and support member 302 from rubber to obtain high compliance as well as to reduce assembly costs and assembly issues such as mechanical buzz and rattle, etc. One type of rubber that can be used is Santoprene Rubber, namely, Santoprene 211–45. Santoprene 211–45 is a thermoplastic vulcanizates (TPV) rubber that can be injection molded. This material is characterized by a Young's (Tensile) Modulus, E, of about 2.5 MPa (per Am. Soc for Testing and Materials (ASTM) D 797.89) at 23° C., and damping "tan(delta)" of 0.07 at 23° C.

At 100 Hz, near the lower end of the transmission band where means to isolate vibration is most difficult, and a terminal operating temperature of 40° C., the viscoelastic and dynamical nature of the Santoprene Rubber yields an effective stiffness modulus of 5.9 MPa (at room temperature it would be even stiffer at 7.1 MPa for reference). In one exemplary embodiment, design optimization of the microphone isolation system 200 uses the full dynamical viscoelastic properties of the material (see ASTM D 5992.96), namely, a 23° C. master curve of the stiffness modulus E(t*) and the compliance modulus D(t*) both over, say, 500 years of time-temperature accelerated time, t*, and an Arhennius plot determining the relation between t* and real time. Note that measured master curves of the moduli E(t*) and D(t*) are inversely related but generally not reciprocal. For further insight, one may consult the paper "Taking the Mystery out of Creep," Plastics Design Forum, Jan/Feb 1982, for a review of viscoelastic creep, time-temperature superposition and modulus master curves, which is incorporated herein by reference for all purposes. One may also refer to the paper "Stress Analysis of Viscoelastic Composite Materials," in the J. of Composite Materials, V. 1, No. 3, July 1967, which is incorporated herein by reference for all purposes. Moreover, specification ASTM D 5992.96 describes dynamical mechanical properties versus temperature from which modulus master curves and time-temperature superposition curves may be obtained, and which is incorporated herein by reference for all purposes.

Design optimization of a microphone isolation system 200 thought to be capable of yielding a high radial-to-normal compliance ratio can be pursued with the aid of a formula related to the deflection of curved beams under various boundary conditions. Matlab™ mathematical software can be used to optimize the microphone isolation system's parameters. For example, analysis may yield an effective or lumped "planar compliance" in the radial direction for the combined eight compliant members 304 of Cp=0.0031 m/N and a lumped "normal compliance" of Cn=0.0080 m/N, both at 100 Hz and 40 C. operation (note that this is the beams' compliance, not that of the material). It is noteworthy that, because of beam orthogonality and linearity, Cp is the same for any planar angle of excitation over 360 degrees. In one embodiment, it is contemplated that Cp is equal to Cn. However, Cp can be greater than or less than Cn. One may consult the text "Roark's Formulas for Stress and Strain," $6^{th}$Ed, McGraw-Hill by Warren C. Young, which is incorporated herein by reference for all purposes, for detailed formulas to help calculate the mechanical compliance and deflections of curved beams. Specifically, for excitation in the plane of curvature, see Table 18, Case 13, with both 5*c* radial loading and with 5*d* tangential loading. For excitation in the plane normal to the curvature, see Table 19, Case 1*e*.

It is noteworthy that the curvature and small width, W, of the compliant members 304 increases Cp by about two orders of magnitude so as to yield a low vibration cutoff frequency, fc. Furthermore, normal compliance, Cn, is maintained as small as possible (via a large H value), yielding a relatively high Cp/Cn ratio of 0.39 in one preferred embodiment. A smaller Cn is preferred because the smaller Cn represent the minimization of initial elastic deflection and creep over time-temperature accelerated time, t*.

In further keeping with embodiments of the present invention, it is desired that vibration velocity-to-velocity transmissibility be minimized. That is, a steady-state vibration velocity of the sidewall 312, Us, should yield a much lower isolation member 300 velocity, Ui. The transmissibility, Tv, is thus defined as 20 log (Ui/Us) in dB. However, it is desired that Tv be negative. Since the electret microphone 202, which is cylindrical in shape with its moving diaphragm in a plane normal to the axis of the cylinder, is placed on the isolation member 300 on its side, then the radial or "planar" vibrations caused by the sidewall 312 are most troublesome. To obtain a desired cutoff frequency (fc) in the planar mode (fcp), defined by an attenuation of 10 dB relative to the use of no isolator, lumped parameter simulation (using equivalent circuit techniques) reveals that additional metal mass, the weight 208 (FIG. 2), should be added to the isolation member 300 to supplement the rather light electret microphone 202. The electret microphone 202 employed herein is the Primo Microphones' EM110 with a mass of approximately $0.9\times10^{-3}$ kgm, although other electret microphones may be utilized. A $4.8\times10^{-3}$ kgm metal mass is found to be desirable for the weight 208, in an alternative embodiment. Finally, the Santoprene isolation member 300 mass plus the effective vibrating mass of the complaint beams 304 equals $0.4\times10^{-3}$ kgm. Thus, the total vibrating mass, M, is $6.1\times10^{-3}$ kgm. It is noteworthy that the overall center of gravity of the isolation member 300 and the electret microphone 202 is located substantially at or slightly above a neutral-axis position of the complaint beams 304, in one embodiment. This configuration helps minimize any rocking motion of the isolation member 300. It is contemplated that the overall center of gravity of the isolation member 300 and the electret microphone 202 is located slightly below the neutral-axis position of the complaint beams 304, in an alternate embodiment. One may consult the text "Mechanical Vibrations," Dover, 1985, by J. P. Den Hartog, and specifically Sec. 2.12 concerning the details of vibration isolation analysis and design. This text is incorporated herein by reference for all purposes.

Figure 4:
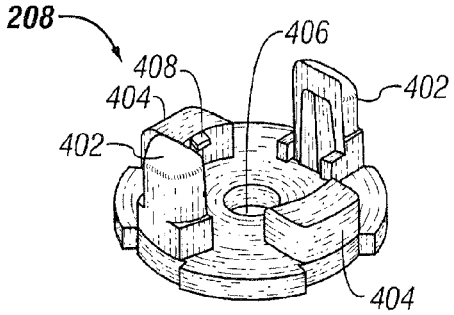
FIG. 4 is a perspective view of a weight of the microphone isolation system of FIG. 2.

Referring now to FIG. 4, the weight 208 is shown. The weight 208 includes a pair of first extensions 402 and a pair of second extensions 404, and defines an aperture 406 therethrough. The first extensions 402 attach to the wedges 308 (FIG. 3) of the top unit 206 (FIG. 2) and help to secure the weight 208 to the isolation member 300 (FIG. 3) and the clamping arrangement 306 (FIG. 3). The second extensions 404 attach to the isolation member 300 (FIG. 3) via nubs 408. These nubs 408 protrude laterally from the second extensions 404 and attach to the isolation member 300. The aperture 406 facilitates the attachment of the weight 208 to the isolation member 300 via a projection (not shown) on the underside of the isolation member 300.

Figure 5:
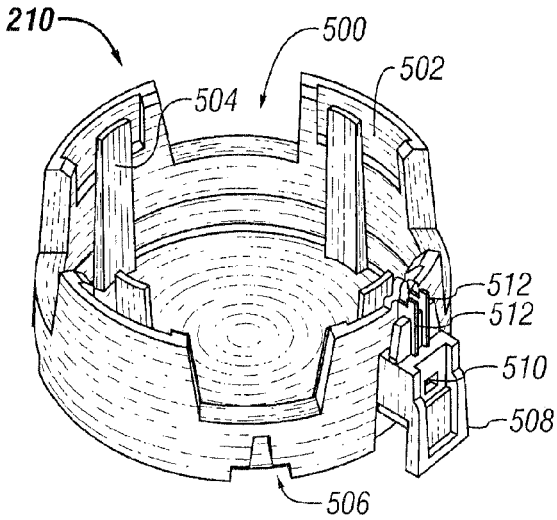
FIG. 5 is a perspective view of a base unit of the microphone isolation system of FIG. 2.

The exemplary base unit 210 is illustrated in FIG. 5. The base unit 210 is preferably formed from plastic, however, the base unit 210 can be formed from any other suitable material. The base unit 210 houses the top unit 206 (FIG. 2) and the weight 208 (FIG. 2). In the present exemplary embodiment, the base unit 210 has four crevices 500. However, the base unit 210 can have more or fewer than four crevices 500. The four crevices 500 line up with the crevices 314 (FIG. 3) of the isolation member 300 (FIG. 3). The crevices 314 and 500 allow incoming acoustical speech waves to approach the microphone isolation system 200 with less destructive interference than would otherwise be the case.

Furthermore, the base unit 210 has four gaps 502, although alternative numbers of gaps 502 may be utilized. The gaps 502 facilitate the attachment of the base unit 210 to the top unit 206. The extended areas 310 (FIG. 3) fit into the gaps 502 to facilitate this attachment.

The base unit 210 further includes four stilts 504. The stilts 504 fit behind the sidewall 312 (FIG. 3) and help to secure the top unit 206 (FIG. 2) to the base unit 210. Furthermore, four indentations 506 facilitate the attachment of the base unit 210 to an assembly (not shown). In other embodiments alternative numbers of stilts 504 and indentations 506 may be utilized.

It is also noteworthy that terminal connector 508 defines aperture 510. The aperture 510 allows for access to a connection to wire leads 512.

Figure 6:
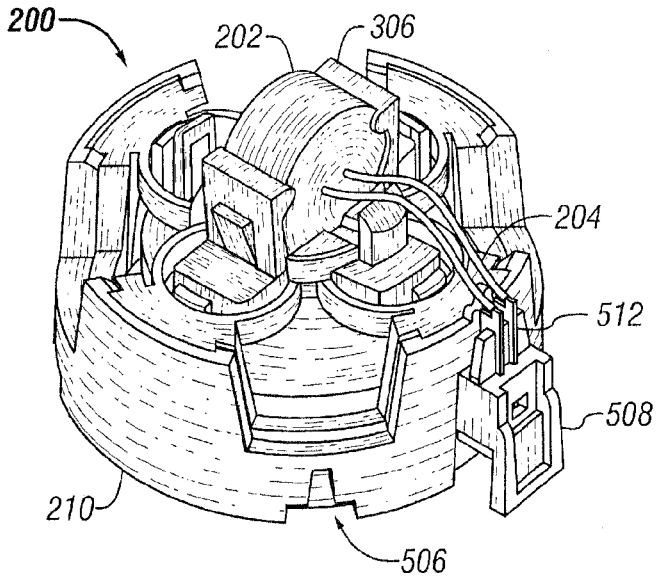
FIG. 6 is a perspective view of the microphone isolation system of FIG. 2 in assembled relation.
Figure 7:
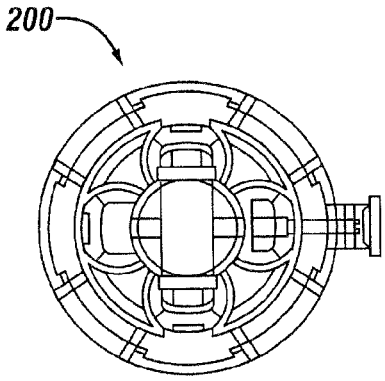
FIG. 7 is a top view of the microphone isolation system of FIG. 6.
Figure 8:
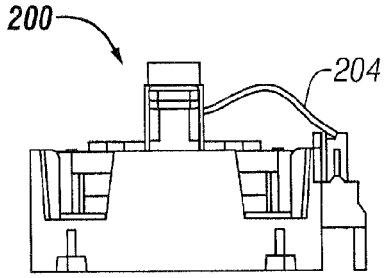
FIG. 8 is an elevated side view of the microphone isolation system of FIG. 6.

FIG. 6 is a perspective view of the microphone isolation system 200 in assembled relation. As is apparent from FIG. 6, the electret microphone 202 is secured by the clamping arrangement 306. The compliant wires 204 are soldered to the electret microphone 202 and to the wire leads 512. The weight 208 (FIG. 2) is affixed to the top unit 206 (FIG. 2), and the base unit 210 secures the top unit 206. FIGS. 7 and 8 show a top view and an elevated side view of this configuration, respectively.

Figure 9:
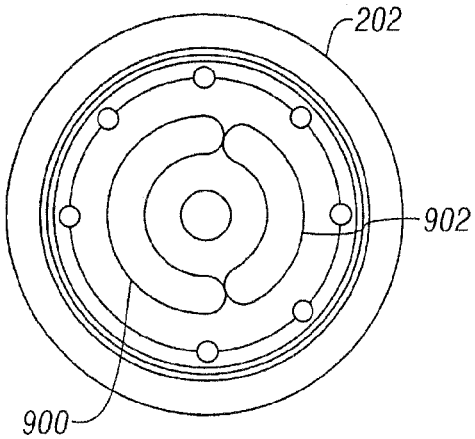
FIG. 9 is a bottom view of one exemplary electret microphone for use with some embodiments according to the present invention.

Referring to FIG. 9, a bottom view of one exemplary electret microphone 202 is depicted. Solder pads 900 (ground) and 902 are shown. The compliant wires 204 (FIG. 2) are soldered to these pads 900 and 902.

In further keeping with exemplary embodiments of the present invention, it is desirable that the electret microphone 202 and the isolation member 300 (FIG. 3) be supported by extremely compliant (low stiffness) spring members, such as the compliant members 304 (FIG. 3), so as to yield a low vibration cutoff frequency. It is desirable that for a given radial excitation of the support member 302 (FIG. 3), the electret microphone 202 exhibits a small displacement and/or velocity.

However, very compliant spring members will generally deflect, and/or "creep" (i.e., move over time) due to viscous deformation caused by superposed time and elevated temperature in service. If the normal deflection of the isolation member 300 causes the isolation member 300 to come into contact with any portion of the isolation system 200, then the isolation properties of the isolation member 300 could be hampered. This poses a major obstacle in the design of a small microphone isolation system 200 for a consumer product.

Figure 10:
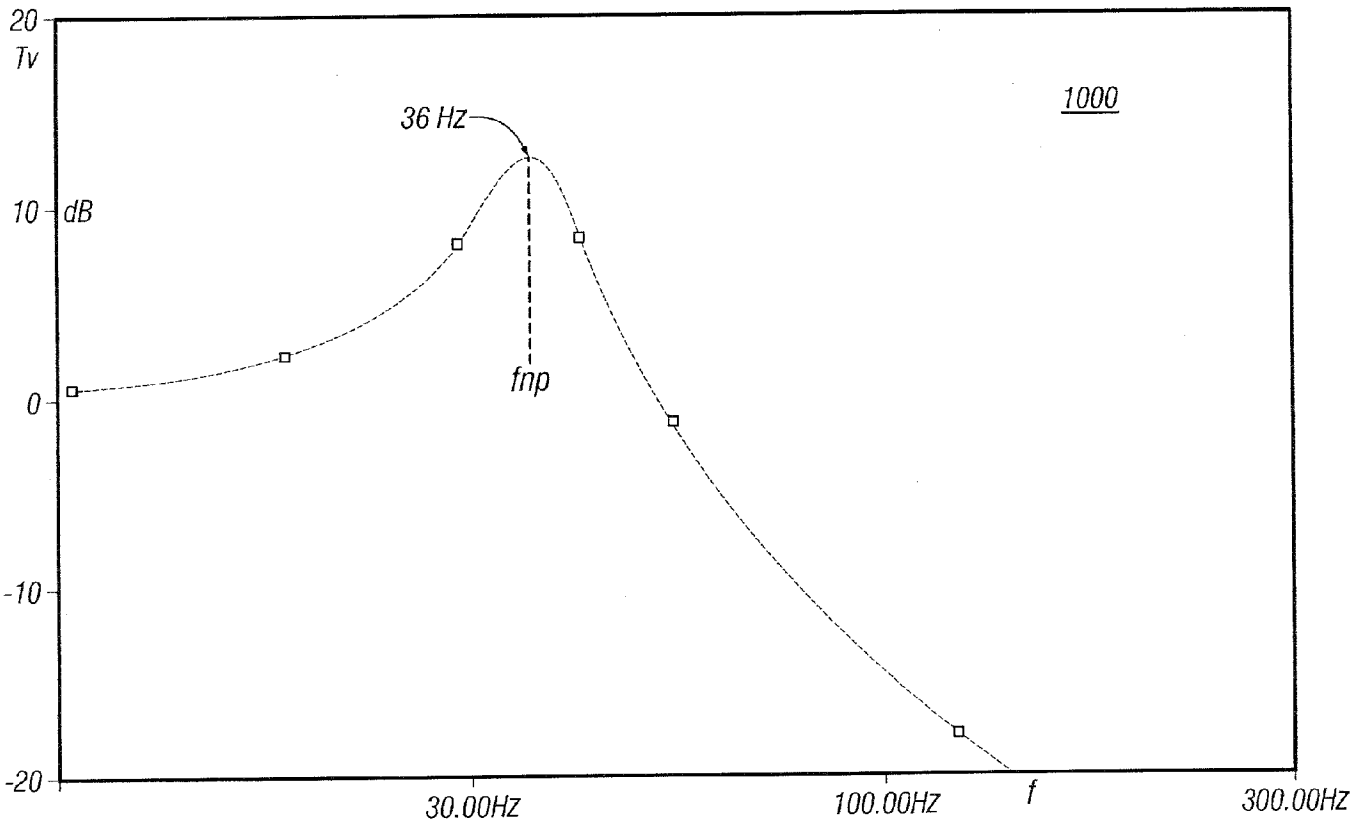
FIG. 10 is an exemplary graph of planar vibration transmissibility versus excitation frequency, according to the present invention.

Referring to FIG. 10, there is depicted an exemplary plot 1000 of Tv versus frequency, f. A fundamental natural frequency of vibration in the planar mode, fn, seen in the plot 1000 is yielded approximately by $2*\pi*fnp=SQRT[1/(MCp)]$, as well known from either mechanical or electrical analogies. One finds fnp=36 Hz.

The relatively large Cp/Cn inherent in this exemplary system hence achieves vibration isolation down to a very low cutoff frequency fcp, suitable for wideband communications. Critical for practical application of the microphone isolation system 300 (FIG. 3) in consumer products, the static deflection of isolation member 300 (about 1.2 mm at 23° C. and 60 seconds after loading) plus dynamical "creep" deflection under a typical lifetime of elevated operating and storage temperature preferably totals about 6.5 mm, or less.

Figure 11:
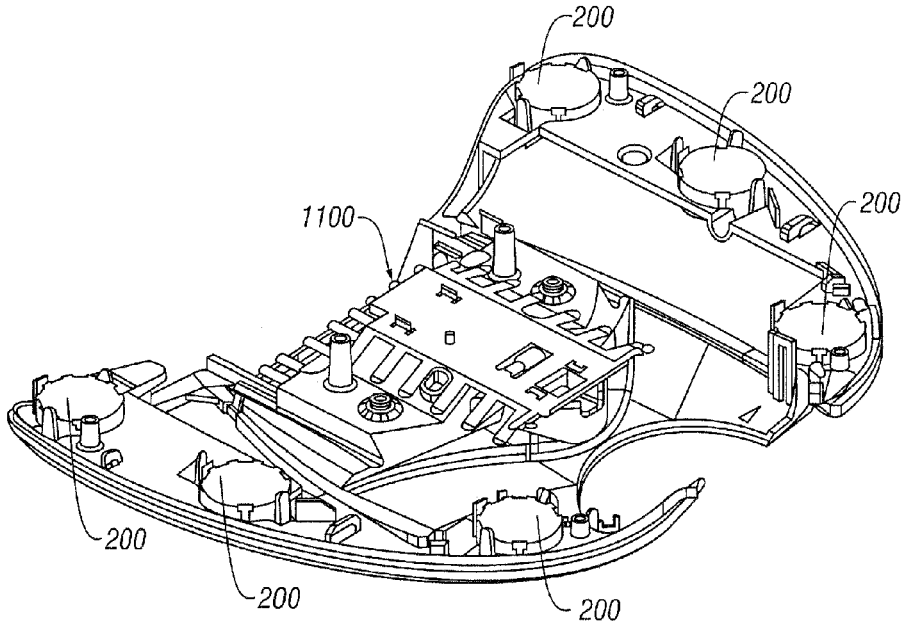
FIG. 11 shows a microphone isolation system secured to a panel of an assembly, according to the present invention.

The microphone isolation system 200 can be implemented in various systems and devices. Referring to FIG. 11, multiple microphone isolation systems 200 are shown secured to an upper housing 1100 of a communications product, according to another exemplary embodiment of the present invention. The microphone isolation systems 200 are shown inverted in the inverted upper housing 1100.

Therefore, an improved microphone isolation system 200 has been shown and described. It is noteworthy that some embodiments according to the present invention are not limited to a microphone isolation system. These embodiments may include a vibration isolator in general, which can be used for various applications.

The above description is illustrative and not restrictive. Many variations of the invention will become apparent to those of skill in the art upon review of this disclosure. The scope of the invention should, therefore, be determined not with reference to the above description, but instead should be construed in view of the full breadth and spirit of the invention as disclosed herein.

What is claimed is:

1. A vibration isolation system for a microphone, the system comprising:

a support member for attachment to a base;

an isolation member connected to the microphone by a clamping arrangement; and a plurality of compliant members disposed between the support member and the isolation member to support the isolation member and reduce transmission of vibration from the base to the microphone, wherein the base defines a plurality of crevices configured to minimize destructive interference to incoming acoustical waves approaching the microphone, and wherein the support member provides support for the plurality of compliant members and is isolated from vibrations from a vibrating source.

2. The vibration isolation system of claim 1, wherein at least one of the plurality of compliant members is curved.

3. The vibration isolation system of claim 2, wherein the at least one compliant member that is curved covers an included angle of at least 30 degrees.

4. The vibration isolation system of claim 2, wherein the at least one compliant member that is curved covers an included angle of at least 90 degrees.

5. The vibration isolation system of claim 2, wherein the curvature exists in a plane parallel to the isolation member.

6. The vibration isolation system of claim 2 wherein the curvature of the at least one of the compliant members is constant.

7. The vibration isolation system of claim 2, wherein the plurality of compliant members are orthogonally symmetric in a plane parallel to the isolation member.

8. The vibration isolation system of claim 2, wherein the plurality of compliant members have a height-to-width ratio that is greater than 2.5.

9. The vibration isolation system of claim 2, wherein the plurality of compliant members are curved and occur in pairs, and each pair comprises two compliant members having opposite curvatures with respect to a radial coordinate.

10. The vibration isolation system of claim 2, wherein a center of gravity of the isolation member plus the microphone is located substantially at a neutral-axis position of the plurality of compliant members.

11. The vibration isolation system of claim 2, wherein the vibration isolation system is configured to isolate the isolation member from vibrations propagating through the support member.

12. The vibration isolation system of claim 1 wherein the base defines four crevices.

13. The vibration isolation system of claim 1 wherein the plurality of compliant members are curved in a plane parallel to the isolation member.

14. The vibration isolation system of claim 1 wherein the plurality of compliant members are arranged orthogonally symmetrically in a plane parallel to the isolation member.

15. The vibration isolation system of claim 1 wherein the plurality of compliant members have a height-to-width ratio that is greater than 2.5.

16. The vibration isolation system of claim 1 wherein a center of gravity of the isolation member plus the microphone is located substantially at a neutral-axis position of the plurality of compliant members.

17. The vibration isolation system of claim 1 wherein the support member, the isolation member, and the plurality of compliant members comprise a unitary molded structure.

18. The vibration isolation system of claim 1 wherein the plurality of compliant members are composed of rubber.

19. A vibration isolation system for a microphone, the system comprising:

a support member for attachment to a base;

an isolation member connected to the microphone by a clamping arrangement;

a plurality of compliant members disposed between the support member and the isolation member to support the isolation member and reduce transmission of vibration from the base to the microphone; and a weight attached to the isolation member, wherein the support member provides support for the plurality of compliant members and is isolated from vibrations from a vibrating source.

20. The vibration isolation system of claim 19 wherein the plurality of compliant members are curved in a plane parallel to the isolation member.

21. The vibration isolation system of claim 19 wherein the plurality of compliant members are arranged orthogonally symmetrically in a plane parallel to the isolation member.

22. The vibration isolation system of claim 19 wherein the plurality of compliant members have a height-to-width ratio that is greater than 2.5.

23. The vibration isolation system of claim 19 wherein a center of gravity of the isolation member plus the microphone is located substantially at a neutral-axis position of the plurality of compliant members.

24. The vibration isolation system of claim 19 wherein the support member, the isolation member, and the plurality of compliant members comprise a unitary molded structure.

25. The vibration isolation system of claim 19 wherein the plurality of compliant members are composed of rubber.

* * * * *